United States Patent [19]

Graalmann et al.

[11] 4,434,563

[45] Mar. 6, 1984

[54] METHOD AND APPARATUS FOR DRYING TOBACCO

[75] Inventors: Gerhard Graalmann, Wohltorf; Heiko Niehues, Hamburg, both of Fed. Rep. of Germany

[73] Assignee: Hauni-Werke Körber & Co. KG., Hamburg, Fed. Rep. of Germany

[21] Appl. No.: 239,172

[22] Filed: Feb. 27, 1981

[30] Foreign Application Priority Data

Feb. 28, 1980 [DE] Fed. Rep. of Germany ..... 3007489

[51] Int. Cl.[3] ..... F26B 3/04; F26B 3/24

[52] U.S. Cl. ..... 34/28; 34/46; 34/48; 34/134; 131/303

[58] Field of Search ..... 34/46, 48, 28, 29, 31, 34/134, 57 A, 10; 131/303, 304

[56] References Cited

U.S. PATENT DOCUMENTS 3,905,123 9/1975 Fowler et al. ..... 34/46

4,143,471 3/1979 Wochnowski et al. ..... 34/28

FOREIGN PATENT DOCUMENTS 1901690 10/1970 Fed. Rep. of Germany .

*Primary Examiner*—Larry I. Schwartz

*Attorney, Agent, or Firm*—Kontler, Grimes & Battersby

[57] ABSTRACT

A continuous stream of tobacco particles is conveyed through a conditioning zone wherein the stream is agitated and is directly contacted by a current of hot air. The moisture content of the thus dried tobacco particles is measured downstream of the conditioning zone and the temperature of hot air is changed when the measured moisture content of dried tobacco particles deviates from a desired value. A second parameter of hot air (e.g., its initial moisture content) is varied when the temperature of freshly dried tobacco particles deviates from a preselected temperature. This ensures that the moisture content of tobacco particles does not fluctuate subsequent to cooling which follows the drying operation.

16 Claims, 4 Drawing Figures

SERVOMOTOR
PID-REGULATOR
SOURCE OF REFERENCE SIGNALS
BOLOMETER
MOISTURE DETECTOR
SOURCE OF REFERENCE SIGNALS
PID-REGULATOR
THERMOMETER
SIGNAL COMPARING STAGE
PID-REGULATOR
SERVOMOTORS
TRANSDUCER
INFRARED RADIATION THERMOMETER

METHOD AND APPARATUS FOR DRYING TOBACCO

BACKGROUND OF THE INVENTION

The present invention relates to a method and apparatus for drying tobacco, and more particularly to improvements in a method and apparatus for drying tobacco which is conveyed in the form of a continuous stream. Still more particularly, the invention relates to improvements in a method and apparatus for drying tobacco which forms a continuous stream and is caused to advance through a conditioning zone wherein the particles of tobacco are directly contacted by a hot gaseous fluid and the heat content of hot air is regulated in dependency on the moisture content of dried tobacco.

German Offenlegungsschrift No. 1,901,690 discloses a method and apparatus for drying tobacco wherein the temperature of a hot gaseous fluid (normally air) which directly contacts tobacco particles in a conditioning zone is maintained at a value which is regulated with a view to ensure that the moisture content of dried tobacco matches or closely approximates the desired moisture content. This means that the moisture content of tobacco particles which leave the conditioning zone is satisfactory (i.e., it matches the desired or optimum moisture content) but the temperature of dried tobacco fluctuates in dependency on fluctuations of the temperature of gaseous fluid which is utilized to directly contact the particles in the conditioning zone for the purpose of removing moisture therefrom. Such fluctuations of the temperature of dried tobacco particles entail fluctuations in the rate of evaporation of moisture upon completion of the drying operation. In other words, once the dried tobacco is cooled, its moisture content is not uniform owing to different rates of evaporation of moisture during cooling. The deviations of moisture content of cooled tobacco from the desired moisture content are not very pronounced but suffice to reduce the quality of the ultimate products, such as cigarettes, for example, by adversely affecting the so-called filling force of tobacco particles in the wrapper of a rod-shaped smokers' product.

OBJECTS AND SUMMARY OF THE INVENTION

An object of the invention is to provide a novel and improved method of reducing the moisture content of tobacco in such a way that the temperature of freshly dried tobacco matches or closely approximates a given value prior to cooling of dried tobacco.

Another object of the invention is to provide a method which ensures that evaporation of some moisture during cooling of freshly dried tobacco will not entail substantial deviations of the final moisture content from a desired optimum value.

A further object of the invention is to provide a method which renders it possible to reduce the moisture content of large quantities of tobacco per unit of time in such a way that the moisture content of dried tobacco varies at a uniform and predictable rate during cooling, i.e., after completion of the drying operation.

An additional object of the invention is to provide a novel and improved apparatus for the drying of tobacco particles in accordance with the above outlined method.

A further object of the invention is to provide a relatively simple, compact and reliable apparatus which can process large quantities of tobacco per unit of time and which can be readily and conveniently adjusted to reduce the moisture content of tobacco particles to any one of a number of different values.

Another object of the invention is to provide the apparatus with novel and improved means for influencing the parameters of the gaseous fluid which contacts and removes moisture from tobacco particles.

An additional object of the invention is to provide the apparatus with novel and improved means for effecting a predictable drying of tobacco particles irrespective of whether the gaseous fluid which removes moisture is caused to flow concurrent with or countercurrent to the direction of transport of tobacco particles through the conditioning zone.

One feature of the invention resides in the provision of a method of drying tobacco which comprises the steps of transporting tobacco (preferably a continuous stream of tobacco) through a conditioning zone, directly contacting tobacco in the conditioning zone with a hot gaseous fluid (e.g., hot air), measuring the moisture content of the thus dried tobacco, comparing the measured moisture content with a predetermined value, regulating the heat content of the gaseous fluid when the measured content of dried tobacco deviates from the predetermined value including regulating a first parameter of the gaseous fluid, measuring the temperature of dried tobacco, and regulating a second parameter of the gaseous fluid when the measured temperature of dried tobacco deviates from a preselected value.

The first parameter can be the temperature of the gaseous fluid, and the second parameter may be the moisture content of such fluid.

The contacting step may comprise circulating a current of hot gaseous fluid along an endless path a portion of which extends through the conditioning zone and the step of regulating the second parameter may comprise admitting fresh gaseous fluid into the current outside of the conditioning zone. In accordance with such method, the step of regulating the second parameter of the gaseous fluid actually involves varying the quantity of fresh gaseous fluid which is admitted into the path as a function of deviations of the measured temperature of dried tobacco from the preselected value.

One of the regulating steps (e.g., the second regulating step) may comprise varying the quantity of gaseous fluid which is admitted into the conditioning zone.

In addition to directly heating tobacco particles in the conditioning zone with a hot gaseous fluid, such particles can also be subjected to an indirect heating action, e.g., to the heating action of steam circulating in portions of the device which defines the conditioning zone.

Highly satisfactory results can be achieved by converting tobacco in the conditioning zone into a fluidized bed during contact with the hot gaseous fluid. Such converting step may include or may take place simultaneously with the step of agitating the particles of tobacco in the conditioning zone in the course of the contacting step.

The step of measuring the temperature of tobacco may include indirectly measuring the temperature of dried tobacco particles outside of the conditioning zone.

The transporting step may include advancing the stream of tobacco particles through the conditioning zone along a substantially horizontal path, and the contacting step may comprise conveying a current of hot gaseous fluid upwardly and across the path of tobacco particles in the conditioning zone. The current of gaseous fluid is preferably decelerated at a level above the path of tobacco particles in the conditioning zone so that the ascending gaseous fluid is incapable of entraining tobacco particles from the stream.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figures 1, 2, 3:
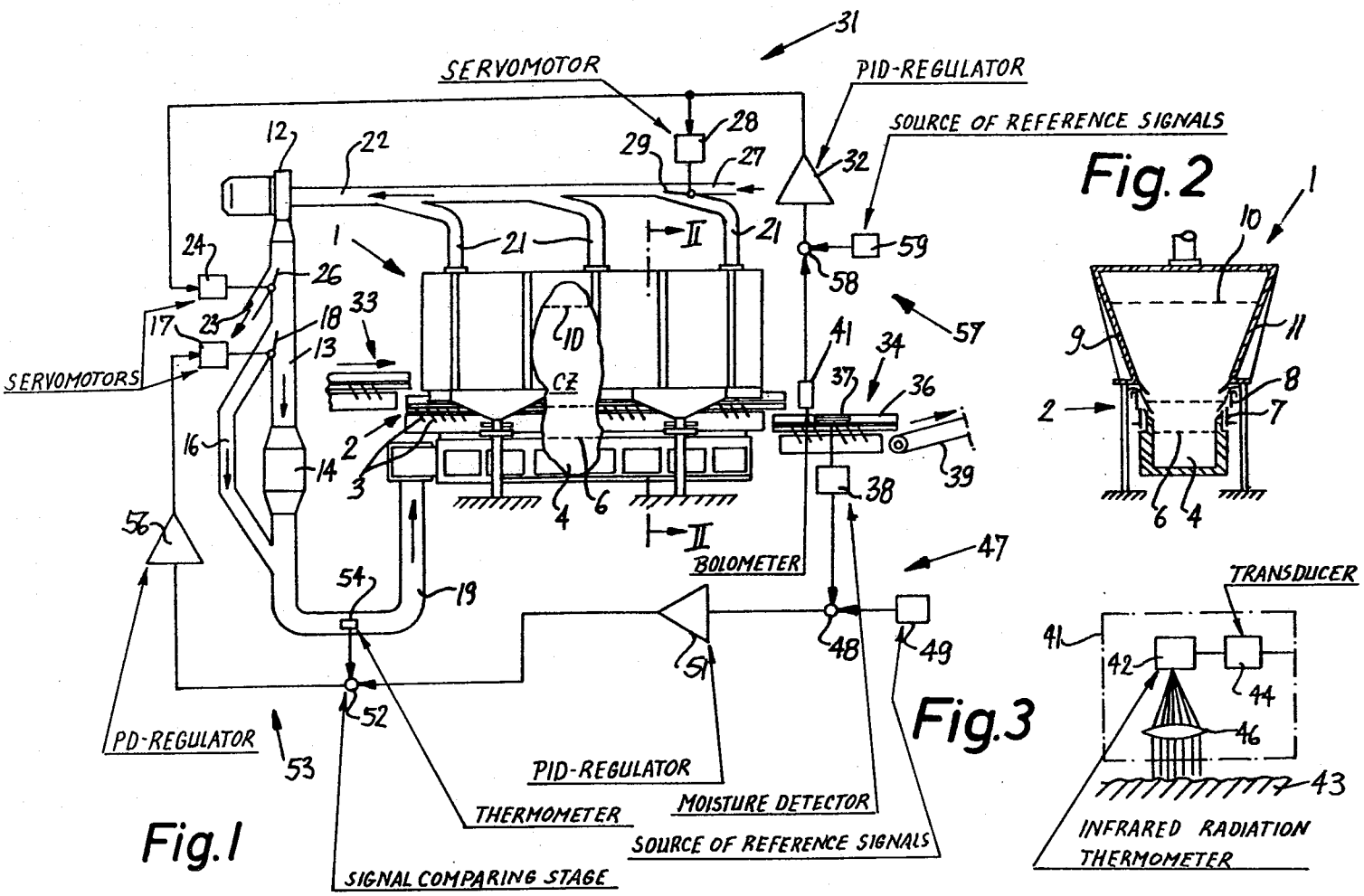
FIG. 1 is a schematic partly elevational and partly sectional view of a drying apparatus which embodies one form of the invention.
FIG. 2 is a transverse vertical sectional view as seen in the direction of arrows from the line II—II of FIG. 1.
FIG. 3 is a diagrammatic view of a tobacco temperature monitoring device in the apparatus of FIG. 1.

FIGS. 1 and 2 show an apparatus which dries tobacco while a stream of tobacco particles is maintained in a fluidized state, i.e., the particles of tobacco in the conditioning zone are agitated so that they float in the gaseous drying fluid. Fluidized bed conditioners for tobacco are disclosed, for example, in commonly owned U.S. Pat. No. 3,799,176 granted Mar. 26, 1974 to Waldemar Wochnowski. The disclosure of this patent is incorporated herein by reference. The apparatus comprises a tobacco transporting unit 1 having a vibratory conveyor 2 which defines the actual drying or conditioning zone CZ. The vibratory conveyor 2 includes an elongated trough-shaped body which is mounted on arms 3 (e.g., leaf springs) and is driven by an electric motor or another prime mover through the medium of one or more eccentrics in a manner described and shown in the aforementioned U.S. Pat. No. 3,799,176 to Wochnowski. The conveyor 2 has apertures for the passage of small currents of hot gaseous fluid (normally air) which is supplied to the underside of the conveyor 2 by an elongated channel 4 containing a plate-like sieve 6 serving to ensure uniform distribution of hot gaseous fluid at the underside of the conveyor 2.

As shown in FIG. 2, the trough of the vibratory conveyor 2 comprises a lower portion 7 and an upper portion 8 which comprises upwardly diverging side walls 9 and 11 to reduce the velocity of the ascending composite current of hot gaseous fluid that is supplied by the channel 4, distributed by the sieve 6 and caused to pass through the apertures in the bottom wall of the lower portion 7 of the conveyor 2. The upper portion 8 of the conveyor 2 contains a horizontal or nearly horizontal intercepting sieve or filter 10 which prevents lighter tobacco particles from being entrained by the ascending current of hot gaseous fluid (hereinafter called air for short). Tobacco particles 43 (see FIG. 3) which are advanced in the lower portion 7 of the conveyor 2 are partially lifted by the ascending small currents of hot air passing upwardly through the perforations of the sieve 6 so that the stream of tobacco particles is fluidized during travel through the conditioning zone CZ. This is the optimum condition for rapid, gentle, thorough and uniform contacting of all tobacco particles with ascending currents of hot air. The speed of the ascending currents decreases in the upper portion 8 owing to the aforediscussed divergence of side walls 9 and 11 so that the particles 43 of tobacco are not likely to clog the intercepting filter 10, i.e., the filter 10 permits hot air to pass therethrough and to enter conduits 21 which admit hot air into a collecting conduit 22.

The current of hot air is caused to circulate along an endless path a portion of which extends through the conditioning zone CZ, i.e., across the sieve 6, across the bottom wall of the lower portion 7, upwardly through the upper portion 8 (with attendant deceleration of the current), through the intercepting filter 10, and into the conduits 21. The discharge end of the collecting conduit 22 is connected to the suction intake of a blower 12 which serves to circulate the current of air along the aforementioned endless path and delivers air to the channel 4 by way of a conduit 13 which contains a heating device 14 (e.g., an electric resistance heater) and a further conduit 19. In order to allow for regulation of the temperature of hot air which enters the conduit 19, the air circulating system in the apparatus of FIG. 1 further comprises a bypass conduit 16 which communicates with the conduit 13 upstream of the heating device 14 and with the conduit 19 downstream of the heating device 14. Thus, that percentage of air which flows through the bypass conduit 16 is not heated on its way into the conduit 19 and thence into the channel 4. The ratio of air which flows through the conduit 13 to air which flows through the bypass conduit 16 can be regulated by a pivotable valve element or flap 18 which is installed at the junction of the conduits 13, 16 and whose angular position can be changed by a suitable servomotor 17 in response to signals from a signal comparing stage 52. The servomotor 17 may constitute a reversible electric motor which can pivot the flap 18 in a clockwise or counterclockwise direction through the medium of a gear train or the like. The flap 18 constitutes a means for influencing the temperature of hot air which flows into the channel 4 and thence into direct contact with the stream of tobacco particles 43 in the conveyor 2. The endless path for the flow of a current of hot air in such a way that a portion of the path extends through the conditioning zone CZ includes the conduits 13, 16, the conduit 19, the channel 4, the conveyor 2, the conduits 21, 22 and the blower 12. The conduit 13 can be said to constitute an extension of the conduit 19 or vice versa.

A further conduit 23 branches off the conduit 13 downstream of the blower 12 to discharge some of the recirculated hot air into the surrounding atmosphere. The junction of the conduits 13 and 23 contains a pivotable valve element or flap 26 whose position can be changed by a servomotor 24 (e.g., a reversible electric motor) which receives signals from a signal comparing stage 58. The angular position of the flap 26 determines the percentage of hot air which is discharged into the atmosphere, and such discharged or released air is replaced by cool fresh atmospheric air which is admitted into the collecting conduit 22 or into one of the conduits 21 upstream of the blower 12 by a supply conduit 27. The junction of the conduits 22 and 27 contains a pivotable valve element or flap 29 whose angular position can be changed by a servomotor 28 (e.g., also a reversible electric motor) which receives signals from the aforementioned signal comparing stage 58. Thus, the blower 12 draws fresh air via supply conduit 27 at the same rate at which the conduit 23 allows recirculated hot air to escape from the conduit 13 downstream of the blower.

The conduits 23, 27 and the associated flaps 26, 29, as well as the corresponding servomotors 24 and 28, together constitute a mixing device 31 which mixes recirculated air with fresh air at a variable rate and ensures that the quantity of hot air which is supplied to the channel 4 per unit of time is constant or practically constant. Note that the signals from the output of the signal comparing stage 58 are transmitted to the servomotor 28 as well as to the servomotor 24 so that the rate of admission of fresh air via conduit 27 can match the rate of discharge of preheated and recirculated air via conduit 23. Thus, the servomotors 24 and 28 are operated in synchronism. The electrical connections between the output of the signal comparing stage 58 and the inputs of the servomotors 24, 28 contain a PID (proportional plus floating plus derivative) regulator 32.

The means for supplying tobacco to the conveyor 2 comprises a vibratory conveyor 33 which admits successive increments of a continuous stream of tobacco particles into the left-hand end portion of the conveyor 2. A second vibratory conveyor 34 is provided to receive successive increments of the stream dried tobacco particles 43 from the right-hand end portion of the conveyor 2, as viewed in FIG. 1. The conveyor 34 comprises a trough 36 with recessed electrodes 37 constituting the capacitor of a high-frequency oscillator circuit which, in turn, forms part of a moisture detector 38, e.g., a detector of the type known as HWK (manufactured and sold by the assignee of the present application). Reference may be had to the assignee's U.S. Pat. No. 3,320,528. The output of the detector 38 transmits signals denoting the actual moisture content of successive increments of the stream of dried tobacco particles 43 passing through the trough 36 of the vibratory conveyor 34. Ihe latter delivers dried tobacco particles to a belt conveyor 39 for delivery to a cooling station, to storage or to another destination. For example, the belt conveyor 39 can deliver dried tobacco particles 43 to a storage duct, not shown.

In addition to means for monitoring the moisture content of dried tobacco particles 43, the apparatus of FIG. 1 further comprises means for monitoring the temperature of freshly dried tobacco particles. The temperature monitoring means is denoted by the reference character 41 and certain component parts thereof are shown in FIG. 3. The monitoring means 41 is a so-called bolometer including an infrared-radiation thermometer 42 which monitors the temperature of tobacco particles 43 without actually contacting the tobacco stream and furnishes appropriate signals to a transducer 44 whose output furnishes electric signals denoting the temperature of successive increments of the tobacco stream. The reference character 46 denotes a condensor lens which bundles the infrared rays and is interposed between the upper side of the tobacco stream and the thermometer 42.

The circuit 47 for regulating the heat content of hot air which is admitted into the channel 4 comprises the aforementioned moisture detector 38 whose output transmits a signal to one input of a signal comparing stage 48. Another input of the stage 48 receives a reference signal from a suitable source 49, e.g., an adjustable potentiometer. The reference signal from the source 49 denotes the desired final moisture content of dried tobacco particles 43. The output of the signal comparing stage 48 is connected with one input of the aforementioned signal comparing stage 52 by way of a PID regulator 51. The stage 52 forms part of a further regulating circuit 53 whose purpose is to adjust the angular position of the flap 18 by way of the servomotor 17. To this end, another input of the signal comparing stage 52 is connected with the output of a thermometer 54 in the conduit 19 and the output of the stage 52 is connected with the servomotor 17 by way of a PD (proportional plus derivative) regulator or controller 56 of known design. The thermometer 54 in the conduit 19 may constitute or comprise a temperature-sensitive semiconductor.

A third regulating circuit 57 includes the aforementioned temperature monitoring device 41 and serves to regulate a parameter, namely, the quantity, of hot air which is recirculated into the channel 4. The output of the monitoring device 41 transmits signals denoting the actual temperature of dried tobacco particles 43 to one input of the aforementioned signal comparing stage 58 another input of which receives reference signals from a suitable source 59 (e.g., an adjustable potentiometer). The reference signals denote a preselected temperature. If the intensity or another characteristic of the reference signals supplied by the source 59 deviates from the corresponding characteristic of signals transmitted by the monitoring device 41, the output of the stage 58 transmits a signal to the servomotors 24 and 28 via PID regulator 32 so that the angular positions of the flaps 26 and 29 are adjusted accordingly.

The operation of the apparatus which is shown in FIGS. 1 to 3 is as follows:

The vibratory conveyor 33 delivers a continuous stream of tobacco particles 43 into the left-hand part of the lower portion 7 of the conveyor 2, as viewed in FIG. 1. The rate of delivery of tobacco particles to the conveyor 2 can be maintained within a desired range by resorting to a suitable weighing device of the type customary in the field of tobacco processing. Reference may be had to FIG. 3 of the aforementioned commonly owned U.S. Pat. No. 3,799,176 to Wochnowski.

The tobacco particles 43 which enter the conveyor 2 form a bed of fluidized tobacco and advance in a direction toward the vibratory conveyor 34. The channel 4 supplies hot air which is distributed by the sieve 6 and forms a plurality of small streamlets rising through the apertures of the bottom wall of the conveyor portion 7 to directly contact the particles of tobacco in the conveyor 2. That portion of the current of air flowing into the channel 4 which has been supplied by the conduit 13 is heated by the heating device 14. The divergent side walls 9 and 11 of the upper portion of the conveyor 2 ensure that at least the majority of particles 43 forming the tobacco stream do not rise to the level of and clog the intercepting filter 10.

Hot air which has contacted the tobacco particles 43 during flow across the conditioning zone CZ is delivered to the intake of the blower 12 by way of the conduits 21 and 22. A certain amount of such air is discharged into the atmosphere via conduit 23, and the discharged air is replaced with fresh air entering the collecting conduit 22 via supply conduit 27.

The detector 38 monitors the moisture content of tobacco particles 43 in the trough 36 of the vibratory conveyor 34 and the resulting signal is compared with the reference signal from the source 49 in the signal comparing stage 48 of the regulating circuit 47. If the intensities or other characteristics of such signals deviate from each other, the stage 48 transmits a signal to the stage 52 via PID regulator 51. The signal at the right-hand input of the stage 52 denotes the desired temperature of hot air in the conduit 19. The actual temperature of such air is determined by the thermometer 54 and, if the actual temperature of hot air deviates from the desired temperature (signal from the PID regulator 51), the output of the stage 52 transmits a signal to the servomotor 17 via PID regulator 56 whereby the servomotor 17 changes the angular position of the flap 18 and thus alters the ratio of heated air (conduit 13) to unheated air (conduit 16) in the current which flows into the conduit 19 and thence into the channel 4. The nature of adjustment via servomotor 17 is such that the deviation of actual moisture content (as determined by the detector 38) from the desired moisture content (source of reference signals 49) is eliminated or reduced to an acceptable value.

The temperature of tobacco particles 43 which leave the vibratory conveyor 2 is determined by the monitoring device 41 which transmits appropriate signals to the lower input of the signal comparing stage 58. Such signals are compared with the reference signal which is transmitted by the source 59. In the event of deviation, the output of the signal comparing stage 58 transmits appropriate signals to the servomotors 24 and 28 through the medium of the PID regulator 32. The circuit 57 regulates the admission of fresh air via supply conduit 27 and the evacuation of recirculated air via conduit 23 in such a way that the quantity of recirculated hot air is increased if the temperature of freshly dried tobacco particles 43 on the vibratory conveyor 34 is below the desired value (selected by setting of the source 59) and that the temperature of recirculated air is reduced if the temperature of freshly dried tobacco particles 43 is excessive.

If the quantity of hot air which is recirculated across the conditioning zone CZ by the blower 12 is increased, the moisture content of such air is increased accordingly because of a reduction of the rate of admission of relatively dry atmospheric air via supply conduit 27. Consequently, the moisture content of air which enters the channel 4 below the conveyor 2 is increased and such air removes a lower percentage of moisture during contact with tobacco particles 43 in the conveyor 2. Therefore, the moisture content of dried tobacco particles 43 in the trough 36 of the vibratory conveyor 34 increases, and such increase is detected and signaled by the moisture detector 38. As a result of such unsatisfactory drying of tobacco, the regulating circuit 53 causes the servomotor 17 to change the angular position of the flap 18 which reduces the rate of air flow via bypass conduit 16 so that the heating device 14 heats a higher percentage of air flowing into the conduit 19 and thence into the channel 4 below the conveyor 2. In other words, an increase in the moisture content of tobacco particles 43 on the conveyor 34 entails an increase of the temperature of air flowing through the conduit 19 and into the channel 4 in order to contact the particles 43 of the tobacco stream in the conveyor 2.

If the percentage of fresh air which is admitted via supply conduit 27 is increased, the percentage of recirculated air which is discharged via conduit 23 is also increased. Consequently, the moisture content of air flowing through the conduit 19 decreases and such air is capable of removing a higher percentage of moisture from the tobacco particles 43 in the conveyor 2. Thus, the drying action upon tobacco particles 43 is more pronounced than warranted by the setting of the source 49 of reference signals whereby the signal from the moisture detector 38 (such signal denotes that the moisture content of tobacco in the conveyor 34 is too low) is transmitted to the stage 48 which, in turn, transmits a signal to the stage 52 where the signal is compared with the signal from the thermometer 54. The output of the stage 52 then causes the servomotor 17 to change the angular position of the flap 18 so that the temperature of air flowing through the conduit 19 and into the channel 4 is reduced accordingly. A reduction of the temperature (first parameter) of air flowing into the channel 4 entails a less pronounced drying action upon tobacco particles 43, i.e., the moisture detector 38 then transmits signals denoting that the moisture content of the tobacco particles has been corrected so that it matches or approximates the moisture content which is selected by the setting of the source 49 of reference signals.

Figure 4:
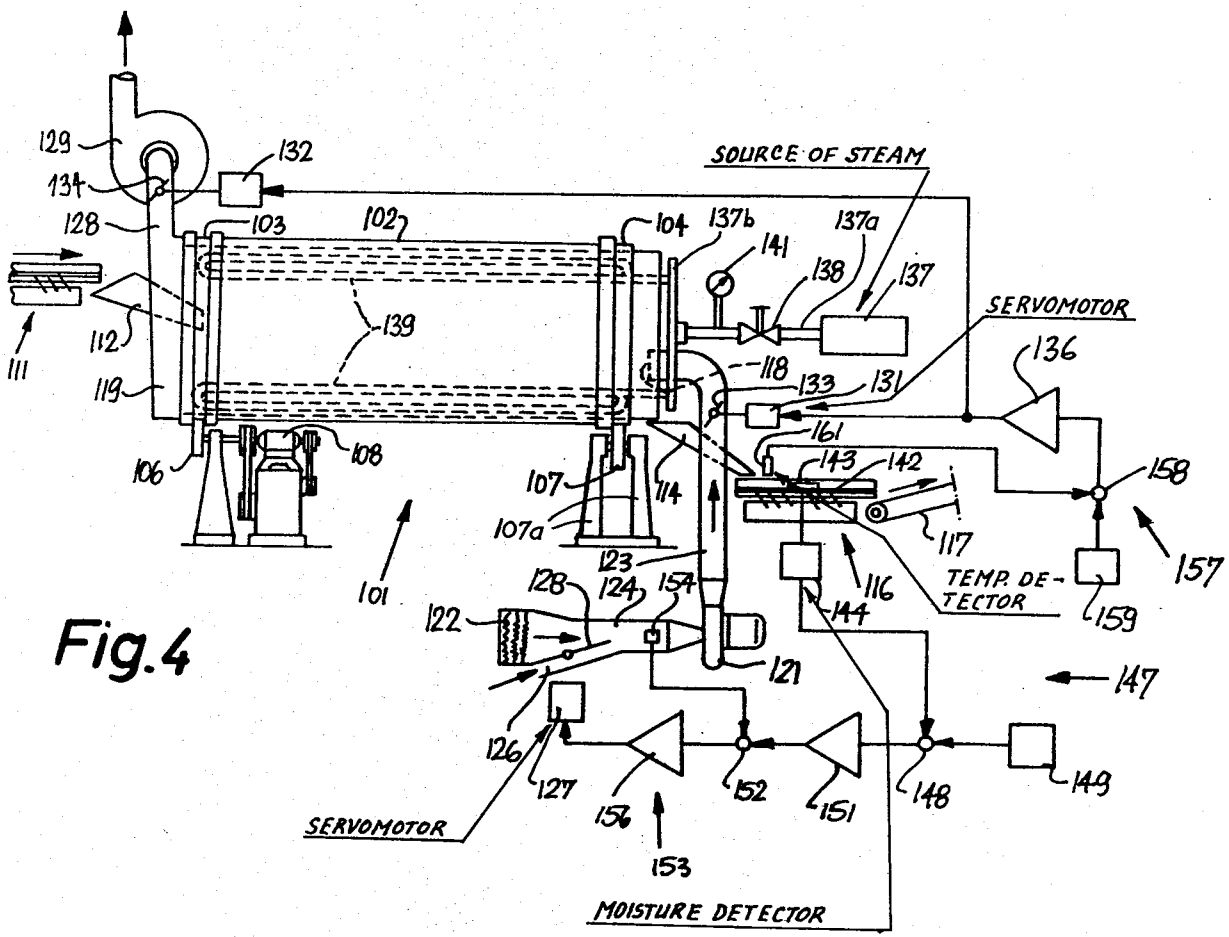
FIG. 4 is a schematic partly elevational and partly sectional view of a second apparatus wherein the conditioning zone is defined by a rotary drum-shaped conveyor.

It will be noted that, when the temperature monitoring device 41 ascertains that the temperature of freshly dried tobacco particles 43 deviates from a preselected temperature (source 59), the flaps 26 and 29 change a parameter of hot air which is other than the temperature, namely, the flaps 26 and 29 change the initial moisture content of air which is admitted into the channel 4. This, in turn, causes the final moisture content of tobacco particles 43 to change because the air current flowing across the fluidized bed of tobacco particles in the conveyor 2 removes a higher or lower percentage of moisture from the tobacco stream. The adjustment is such that the moisture content of tobacco is changed in a direction to reduce the deviation of the signal at the output of the detector 38 from the signal at the output of the source 49. Thus, the apparatus of FIG. 1 renders it possible to maintain the moisture content of tobacco particles at a constant value as well as to prevent undesirable deviations of the temperature of dried tobacco from a preselected value. Consequently, when the tobacco particles leaving the conveyor 34 are cooled, the rate of evaporation of additional moisture is substantially constant so that the moisture content of dried and cooled tobacco particles does not fluctuate at all or fluctuates only within an extremely narrow range which ensures that the filling force of a rod-like filler which is produced from dried and cooled tobacco particles is constant or at least more satisfactory than if the tobacco were treated in accordance with heretofore known procedures which involve adjustment of a single parameter of the gaseous fluid. As explained above, the second parameter (initial moisture content) of hot gaseous fluid is varied by regulating the ratio of fresh atmospheric air (admitted via conduit 27) to the ratio of recirculated hot air (namely, of air which is allowed to bypass the conduit 23 on its way toward the heating device 14 in the conduit 13 or into the bypass conduit 16). Such mode of influencing the temperature of tobacco particles in the conditioning zone CZ is especially desirable in apparatus wherein the conveyor (2) which transports tobacco particles through the conditioning zone causes or enables the tobacco stream to form a bed of fluidized particles. A prerequisite for establishment and predictable maintenance of a fluidized bed in the conditioning zone is the delivery of hot gaseous fluid at a constant rate. If the tobacco stream is dried in a conditioning zone with a rotating drum in a manner as shown in FIGS. 4 and 5, the rate of supply of hot air can be changed instead of changing the initial moisture content of the current of gaseous fluid. This is due to the fact that the coils in the interior of the rotating drum act not unlike blades or vanes which ensure adequate agitation of tobacco particles and satisfactory contact between the current of hot gaseous fluid and all sides of each tobacco particle regardless of whether or not the rate of admission of hot gaseous fluid into the drum is constant.

The mixing device 31 is particularly desirable and advantageous in the apparatus of FIG. 1 wherein the conditioning zone CZ is defined by the vibratory conveyor 2 (rather than by a rotary drum).

FIG. 4 illustrates a modified transporting unit 101 which comprises a drying conveyor 102 constituting a slightly inclined drum which is rotatable about its own axis. The external surface of the drum-shaped conveyor 102 is provided with two endless circumferential tracks 103 and 104 for rollers 106, 107. The rollers 107 are idler rollers which are mounted in upright members 107*a*. The rollers 106 can constitute gears which are driven by an electric motor 108 so that they rotate the drum-shaped conveyor 102 (hereinafter called drum) in a clockwise or counterclockwise direction. The track 103 may include a ring gear for the rollers or gears 106.

The means for supplying tobacco particles into the left-hand end portion of the drum 102 comprises a vibratory conveyor 111 which corresponds to the conveyor 33 of the apparatus shown in FIG. 1 and admits tobacco particles into an inclined chute 112 for delivery directly into the interior of the drum 102. Dried tobacco particles enter a chute 114 which delivers such particles onto a second vibratory conveyor 116 corresponding to the conveyor 34 of FIG. 1. The discharge end of the vibratory conveyor 116 delivers dried tobacco particles to a belt conveyor 117 which admits dried tobacco particles into a cooling device, into a storage duct or onto a further conveyor, not shown.

The drum 102 is heated by a first heat generating device which comprises coils 139 installed in its interior and extending in parallelism with the direction of travel of tobacco particles from the chute 112 toward the chute 114. The coils 139 receive a heating medium (preferably steam) from a suitable source 137 by way of a conduit 137*a* containing a regulatable valve 138 and connected to a pressure gauge 141. The conduit 137*a* delivers hot steam to a stationary manifold 137*b* which is connected with the rotating or orbiting coils 139. The coils 139 not only heat the tobacco particles which are admitted by the chute 112 but also agitate such particles as a result of rotation of the drum 102 about its own axis. The just described parts including the source 137 and the coils 139 constitute one of the two means for heating tobacco particles in the interior (i.e., in the conditioning zone) of the drum 102. The other heating means comprises a blower 121 which draws atmospheric air through a heating device 122 (e.g., an electric resistance heater) at the intake end of a suction pipe 124 which is connected to the intake of the blower 121. The outlet of the blower 121 delivers hot air into a conduit 123 corresponding to the conduit 19 of the apparatus shown in FIG. 1. The outlet of the conduit 123 is shown at 118; this outlet delivers hot air into the discharge end of the drum 102 so that the current of hot air issuing from the conduit 123 flows countercurrent to the direction of travel of tobacco particles from the chute 112 toward the chute 114. The left-hand end portion of the drum 102 is connected with a hood 119 which collects spent hot air and has an outlet 128 connected to the intake of a blower 129 serving to discharge spent hot air into the surrounding atmosphere.

The suction pipe 124 upstream of the blower 121 has an inlet 126 whose effective area is controlled by a valve member or flap 128 which is pivotable by a servomotor 127 (for example, a reversible electric motor). By changing the angular position of the flap 128, the apparatus of FIG. 4 can alter the ratio of heated air which flows from the heating device 122 toward the inlet of the blower 121 to unheated air which enters the suction pipe 124 via inlet 126. In other words, the temperature (first parameter) of hot air which is discharged into the right-hand end portion of the drum 102 can be regulated by changing the angular position of the flap 128 in the suction pipe 124. The temperature of tobacco particles in the drum 102 can be regulated by adjusting (e.g., by hand) the valve 138 in the conduit 137*a*. However, adjustment of the valve 138 involves relatively long-range regulation of the temperature of tobacco particles in the drum 102. On the other hand, a change in the angular position of the flap 128 entails a practically instantaneous regulation or change in the temperature of tobacco particles issuing from the drum 102. The conduit 123 contains a pivotable valve member or flap 133 which can be adjusted by a servomotor 131 receiving signals from a PID regulator 136. The output of the PID regulator 136 further transmits signals to a servomotor 132 which regulates the angular position of a valve member or flap 134 in the outlet 128 of the hood 119. Connection of the servomotors 131 and 132 to the output of a common regulator (136) ensures that the angular position of the flap 133 is changed in synchronism with the angular position of the flap 134.

The vibratory conveyor 116 comprises a measuring trough 142 which contains recessed electrodes 143 constituting the capacitor of a high-frequency oscillator circuit forming part of a moisture detector 144. This detector corresponds to the detector 38 shown in FIG. 1.

The reference character 147 denotes a regulating circuit which controls the heat content of hot air flowing through the conduit 123 and into the discharge end of the drum 102. This circuit comprises a signal comparing stage 148 having a first input which receives signals from the moisture detector 144 and a second input receiving reference signals from a source 149. Such reference signals denote the desired or predetermined moisture content of dried tobacco. The output of the stage 148 can transmit signals to a second stage 152 by way of a PID regulator 151 corresponding to the regulator 51 of FIG. 1. The stage 152 forms part of a second regulating circuit 153, and a second input of this stage receives signals from a thermometer 154 which is installed in the suction pipe 124 downstream of the inlet 126 to furnish signals which denote the temperature of hot air flowing into the conduit 123. When the intensity of signals which are furnished by the thermometer 154 deviates from the intensity of signals at the output of the PID regulator 151, the output of the stage 152 transmits an appropriate signal to the input of the servomotor 127 by way of a PD regulator 156 corresponding to the regulator 56 of FIG. 1.

The reference character 157 denotes a circuit which regulates the quantity of air that is circulated through the drum 102 per unit of time. This regulating circuit comprises a signal comparing stage 158 with an output connected to the aforementioned PID regulator 136. A first input of the stage 158 is connected to a source 159 of reference signals denoting the preselected or desired temperature of dried tobacco particles. Another input of the stage 158 is connected to a temperature monitoring device 161 which corresponds to the device 41 of FIG. 3 and is adjacent to the path of tobacco particles in the vibratory conveyor 116. The output of the PID regulator 136 is connected with the aforementioned servomotors 131 and 132. The arrangement is such that, when the rate of admission of hot air via conduit 123 is reduced, the flap 134 in the outlet 128 of the hood 119 reduces the rate of evacuation of spent hot air via blower 129.

The operation of the apparatus which is shown in FIG. 4 is as follows:

The vibratory conveyor 111 delivers a continuous stream of tobacco particles to the chute 112 which delivers the particles into the left end portion of the rotating drum 102. The hood 119 is stationary and is provided with a suitable aperture or cutout to enable the chute 112 to deliver tobacco particles to be treated into the conditioning zone in the interior of the drum 102.

The drum 102 is rotated by the electric motor 108 through the intermediary of rollers 106 so that the coils 139 of the steam-heating device including the source 137 heat and agitate the particles of tobacco advancing from the chute 112 toward the chute 114. The heating action of the coils 139 effects some drying of tobacco particles in the conditioning zone. Additional drying action is furnished by hot air which is supplied by the outlet 118 of the conduit 123 and flows in a direction from the discharge end of the drum 102 toward and into the hood 119, i.e., counter to the direction of transport of tobacco particles from the chute 112 toward the chute 114.

Freshly dried tobacco particles leave the drum 102 at its right-hand end and descend into the chute 114 which delivers the particles into the trough 142 of the vibratory conveyor 116. The conveyor 116 delivers dried tobacco particles to the belt conveyor 117 for transport to a further destination.

The moisture content of dried tobacco which leaves the drum 102 is monitored by the detector 144 during travel of tobacco particles in the trough 142 of the conveyor 116. The signals at the output of the detector 144 denote the actual moisture content of tobacco particles which have been subjected to a conditioning action in the interior of the drum 102. The signals from the detector 144 are compared with signals from the source 149, and the output of the stage 148 transmits signals to the stage 152 (via PID regulator 151) whenever the actual moisture content of dried tobacco particles deviates from the desired or predetermined moisture content.

The signal at the right-hand input of the signal comparing stage 152 is indicative of the difference between the desired and actual moisture contents of tobacco particles on the conveyor 116. Such signal is compared with the signal which is transmitted by the thermometer 154 and denotes the temperature of hot air flowing toward and into the conduit 123. If the difference between the two signals is sufficient to warrant an adjustment of the flap 128, the output of the stage 152 transmits a signal to the input of the servomotor 127 by way of the PD regulator 156 whereby the servomotor 127 changes the angular position of the flap 128 and, consequently, the ratio of cold atmospheric air which is admitted via inlet 126 to heated air which has passed through the heating device 122. The just described mode of regulation ensures that the moisture content of tobacco on the conveyor 116 is changed as soon as the stage 148 detects a sufficient deviation of actual moisture content from the desired or preferred moisture content (note the source 149 of reference signals).

The device 161 monitors the temperature of freshly dried tobacco particles on the conveyor 116 and transmits appropriate signals to the left-hand input of the stage 158 in the regulating circuit 157. The other input of the stage 158 receives from the source 159 signals denoting the preselected or desired temperature of dried tobacco particles and, when necessary, this stage transmits a signal to the PID regulator 136 for the servomotors 131 and 132. The arrangement is such that, when the temperature of tobacco particles on the conveyor 116 is below the preselected value denoted by the signals from the source 159, the flap 133 admits a larger quantity of heated air into the conditioning zone in the interior of the drum 102 and, at the same time, the flap 134 increases the rate of evacuation of spent hot air via blower 129. On the other hand, if the temperature of freshly dried tobacco particles on the conveyor 116 is too high, the flap 133 reduces the rate of admission of hot air into the right-hand portion of the conditioning zone in the interior of the drum 102. In other words, the regulator 136 can change the quantity of hot air that flows through the conditioning zone per unit of time.

If the quantity of hot air that flows through the drum 102 per unit of time is increased by appropriate adjustment of the angular positions of the flaps 133 and 134, the air which flows through the drum 102 and into the hood 119 removes a higher percentage of moisture from the tobacco particles which are transported by the orbiting coils 139. This entails excessive drying of tobacco particles, and the moisture detector 144 transmits appropriate signals to the stage 148. The stage 148 initiates a change in the angular position of the flap 128 so that the temperature of hot air flowing into the conduit 123 is reduced accordingly. Such adjustment of the flap 128 also causes a reduction of the temperature of dried tobacco particles in the conveyor 116 so that the signal which is generated by the temperature monitoring device 161 denotes that the temperature of dried tobacco has been reduced to a value which corresponds to or sufficiently approximates the value which is selected by the setting of the source 159.

The regulation which is illustrated in FIG. 4 in connection with a countercurrent drying apparatus is useful, in principle, also in an apparatus wherein the stream of tobacco advancing through a conditioning zone is contacted by hot air which flows concurrent with tobacco particles. Instead of regulating the rate of flow of air through the conditioning zone (as described in connection with FIG. 4), the apparatus utilizing drying air which flows concurrent with tobacco particles is preferably or can be constructed in a manner as described in connection with FIG. 1, namely, in such a way that the quantity of air flowing through the conditioning zone is maintained at a constant value but the initial moisture content of air can be changed by regulating the ratio of recirculated hot air to admitted fresh atmospheric air. The recirculated hot air can be said to constitute vapors which are laden with moisture that has been withdrawn from tobacco particles during contact of hot air with tobacco particles in the conditioning zone.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A method of drying tobacco, comprising the steps of transporting a continuous stream of tobacco particles through a conditioning zone; directly contacting tobacco particles in the conditioning zone with a hot gaseous fluid; converting tobacco particles in the conditioning zone into a fluidized bed during contact with hot gaseous fluid; measuring the moisture content of the thus dried tobacco particles; comparing the measured moisture content with a predetermined value; regulating the heat content of the gaseous fluid when the measured moisture content deviates from said predetermined value, including regulating a first parameter of such fluid outside of the conditioning zone; measuring the temperature of dried tobacco particles; comparing the measured temperature with a preselected value; and regulating a second parameter of the gaseous fluid outside of the conditioning zone when the measured temperature of tobacco particles deviates from said preselected value.

2. The method of claim 1, wherein said first parameter is the temperature of the gaseous fluid.

3. A method of drying tobacco, comprising the steps of transporting a continuous stream of tobacco particles through a conditioning zone; directly contacting tobacco particles in the conditioning zone with a hot gaseous fluid including circulating a current of said hot gaseous fluid along an endless path a portion of which extends through said conditioning zone; measuring the moisture content of the thus dried tobacco particles; comparing the measured moisture content with a predetermined value; regulating the heat content of the gaseous fluid when the measured moisture content deviates from said predetermined value, including regulating a first parameter of such fluid outside of the conditioning zone; measuring the temperature of dried tobacco particles; comparing the measured temperature with a preselected value; and regulating a second parameter of the gaseous fluid outside of the conditioning zone when the measured temperature of tobacco particles deviates from said preselected value including admitting fresh gaseous fluid to said current outside of said conditioning zone, said second parameter constituting the temperature of gaseous fluid.

4. The method of claim 3, wherein said gaseous fluid is air.

5. The method of claim 3, further comprising the step of indirectly heating tobacco particles in said conditioning zone.

6. The method of claim 3, further comprising the step of agitating the tobacco particles in said conditioning zone in the course of said contacting step.

7. The method of claim 3, wherein said temperature measuring step includes indirectly measuring the temperature of tobacco particles outside of said conditioning zone.

8. The method of claim 3, wherein said step of regulating said second parameter further includes varying the quantity of fresh gaseous fluid which is admitted into said path as a function of deviations of the measured temperature of dried tobacco particles from said preselected value.

9. Apparatus for drying tobacco, comprising means for transporting a continuous stream of tobacco particles along a predetermined path, said transporting means including means defining a conditioning zone occupying a portion of said path so that the particles of said stream pass therethrough; means for directly contacting the particles of tobacco in said conditioning zone with a hot gaseous fluid including conduit means for supplying said hot gaseous fluid to said conditioning zone, said conduit means including a first conduit, a heating device in said conduit, a second conduit branching off said first conduit ahead of said heating device and merging into said first conduit downstream of said heating device, and means for supplying gaseous fluid to said first conduit upstream of said second conduit; means for measuring the moisture content of dried tobacco particles; means for comparing the measured moisture content with a predetermined value denoting the desired moisture content of dried tobacco particles; means for regulating the heat content of gaseous fluid outside of said conditioning zone when the measured moisture content deviates from said predetermined value including means for regulating the temperature of the gaseous fluid, said regulating means comprising means for regulating the temperature of gaseous fluid ahead of said conditioning zone and said temperature regulating means including means for varying the quantity of gaseous fluid which flows through said second conduit and bypasses said heating device; means for measuring the temperature of dried tobacco particles; means for comparing the measured temperature with a preselected value denoting the desired temperature of dried tobacco particles; and means for regulating a second parameter of gaseous fluid outside of said conditioning zone when the measured temperature of dried tobacco particles deviates from said preselected value.

10. The apparatus of claim 9, wherein said contacting means includes means for supplying to said conditioning zone a current of hot gaseous fluid at a substantially constant rate.

11. The apparatus of claim 10, wherein said supplying means includes means for mixing gaseous fluid with cool atmospheric air outside of said conditioning zone.

12. The apparatus of claim 9, wherein said gaseous fluid is hot air.

13. A method of drying tobacco, comprising the steps of transporting a continuous stream of tobacco particles through a conditioning zone including advancing the stream through said conditioning zone along a substantially horizontal path; directly contacting tobacco particles in the conditioning zone with a hot gaseous fluid including conveying a current of hot gaseous fluid upwardly and across the path of tobacco particles in said conditioning zone; measuring the moisture content of the thus dried tobacco particles; comparing the measured moisture content with a predetermined value; regulating the heat content of the gaseous fluid when the measured moisture content deviates from said predetermined value, including regulating a first parameter of such fluid outside of the conditioning zone; measuring the temperature of dried tobacco particles; comparing the measured temperature with a preselecte value; and regulating a second parameter of the gaseous fluid outside of the conditioning zone when the measured temperature of tobacco particles deviates from said preselected value.

14. The method of claim 13, further comprising the step of decelerating the current of gaseous fluid at a level above the path of tobacco particles in said conditioning zone so that the ascending fluid is incapable of entraining particles of tobacco from said stream.

15. Apparatus for drying tobacco comprising means for transporting a continuous stream of tobacco particles along a predetermined path, said transporting means including means defining a conditioning zone occupying a portion of said path so that the particles of said stream pass therethrough; means for directly contacting particles of tobacco in said conditioning zone with a hot gaseous fluid including first conduit means for collecting the gaseous fluid which has contacted the particles of tobacco in said conditioning zone and second conduit means for returning the thus collected fluid to said conditioning zone; means for measuring the moisture content of dried tobacco particles; means for comparing the measured moisture content with a predetermined value denoting the desired moisture content of dried tobacco particles; means for regulating the heat content of gaseous fluid outside of said conditioning zone when the measured moisture content deviates from said predetermined value, including means for regulating the temperature of the gaseous fluid ahead of said conditioning zone; means for measuring the temperature of dried tobacco particles; means for comparing the measured temperature with a preselected value denoting the desired temperature of dried tobacco particles; and means for regulating a second parameter of gaseous fluid outside of said conditioning zone when the measured temperature of dried tobacco particles deviates from said preselected value including means for varying the quantity of gaseous fluid which is returned to said conditioning zone by way of said second conduit means.

16. The apparatus of claim 15, wherein said varying means includes means for admitting fresh atmospheric air to gaseous fluid in said first conduit means.

* * * * *